United States Patent [19]

Wilson et al.

[11] Patent Number: 4,770,097

[45] Date of Patent: Sep. 13, 1988

[54] MINING METHOD WITH NO DELAY BETWEEN SHOT INITIATOR AND FIRING

[75] Inventors: John W. Wilson; Arthur E. Roffe, both of Springs; Derek O'Beirne, Edenvale; Ratikant Koovarjee, Benoni; Ivan M. Pleaner, Springs; Rolf C. Böhme, Midrand, all of South Africa

[73] Assignee: General Mining Union Corporation Limited, Johannesburg, South Africa

[21] Appl. No.: 69,209

[22] Filed: Jul. 1, 1987

[30] Foreign Application Priority Data

Jul. 4, 1986 [ZA] South Africa ..... 86/4985

[51] Int. Cl.[4] ..... F42D 3/00

[52] U.S. Cl. ..... 102/312; 102/313; 102/202.7; 102/202.13; 299/13

[58] Field of Search ..... 102/311, 312, 313, 202.9, 102/202.13, 275.3, 275.6; 299/13

[56] References Cited

U.S. PATENT DOCUMENTS

| | | | |
|---|---|---|---|
| 2,891,476 | 6/1959 | Forsyth | 102/27 |
| 3,714,895 | 2/1973 | Rawson | 102/23 |
| 3,987,733 | 10/1976 | Spraggs et al. | 102/27 R |
| 4,326,752 | 4/1982 | Ricketts | 299/13 |
| 4,350,097 | 9/1982 | Bowman et al. | 102/275.2 |
| 4,406,226 | 9/1983 | Davitt et al. | 102/311 |

*Primary Examiner*—Peter A. Nelson

*Attorney, Agent, or Firm*—Murray and Whisenhunt

[57] ABSTRACT

A method for the electrical sequential initiation of explosions in which a series of detonators (D1–D11) is located in association with a series of explosive charges spaced from one another and in which a shot initiator 12 is used sequentially to initiate firing of the detonators at selected intervals to detonate the explosive charges, characterized in that each detonator is fired without the provision of a delay between the initiation of firing of the detonator at the shot initiator and the actual commencement of firing of the detonator, further characterized in that the interval between the firing of successive detonators is selected from a range of 5 ms to 40 ms.

7 Claims, 4 Drawing Sheets

MINING METHOD WITH NO DELAY BETWEEN SHOT INITIATOR AND FIRING

BACKGROUND TO THE INVENTION

This invention relates to a mining method and more particularly to a method for the electrical sequential initiation of explosions in mines.

The accurate sequencing of explosions in underground mining operations is of the utmost importance. In advancing a tunnel or stope, sequential blasting is used to ensure that rock is moved in the requried direction and to achieve efficient "chiselling" of the rock mass. Both out-of-sequence blasts and misfires can accordingly have significant adverse effects on mining production.

In concentrated reef mining, blast holes are drilled at spaced positions along the stope face. The holes are often staggered, with the upper ones inclined upwardly and the lower ones inclined downwardly. Each hole is charged with an explosive charge surrounding a detonator. Up to now it has been proposed to use a delay element associated with each detonator. The delay element can be a fuse which burns in the hole or it can be provided in the detonator itself, in which case it can function electronically or chemically.

Initiating means are used to initiate the series of delay elements according to the sequence of explosions required. If all the delay elements are initiated before the first explosion occurs, the initiating means are not disrupted or cut off. However, in some cases initiation can still be in progress when the first explosion occurs.

One of the most important factors in the provision of means for the control of sequenced explosions in mining operations, is cost. The most inexpensive initiating system is the pyrotechnic igniter cord system using an in-hole fuse, but this system results in a significant percentage of misfires and out-of- sequence blasts. Electrical initiation systems, on the other hand, are usually too costly to be commercially viable for large scale use.

It is accordingly an object of the invention to provide a method for the electrical sequential initiation of explosions which is relatively simple and which can be performed at relatively low cost.

SUMMARY OF THE INVENTION

A method according to the invention for the electrical sequential initiation of explosions in which a series of detonators is located in association with a series of explosive charges spaced from one another and in which a shot initiator is used sequentially to initiate firing of the detonators at selected intervals to detonate the explosive charges, is characterised in that each detonator is fired without the provision of a delay between the initiation of firing of the detonator at the shot initiator and the actual commencement of firing of the detonator and is further characterised in that the interval between the firing of successive detonators is selected from a range of 5 ms to 40 ms.

In one form the firing interval may be between 8 ms and 15 ms.

In the absence of a delay in the firing of each detonator, the apparatus used in carrying out the method of the invention can be of relatively simple configuration. It may comprise a series of initiating modules connected to one another and to a shot initiator, and, a corresponding series of electrically actuable initiators each associated with one of the detonators and adapted to fire it, each module being connected to an initiator, each module comprising switching means actuable to actuate the initiator associated with that module, the switching means of each module save the first in the series being connected to the initiator associated with the preceding module in the series, the arrangement being such that the switching means of each module is disabled until the initiator associated with the preceding module in the series has been actuated by that module, the modules in the series being adapted sequentially to be actuated by the shot initiator so as sequentially to actuate the series of initiators and thereby to fire the detonators.

Each initiator may comprise a fusible metal link which is rendered an open circuit when fused. Preferably each initiating module is encapsulated in a connector having prongs on one side and corresponding sockets on an opposite side, adjacent connectors being adapted to be connected by lengths of electrical cable having connecting elements at opposite ends thereof carrying prongs and sockets respectively corresponding to those of the connectors.

BRIEF DESCRIPTION OF THE DRAWINGS

A preferred embodiment of the invention will now be described by way of example with reference to the accompanying drawings in which.

DESCRIPTION OF PREFERRED EMBODIMENT

Figure 2:
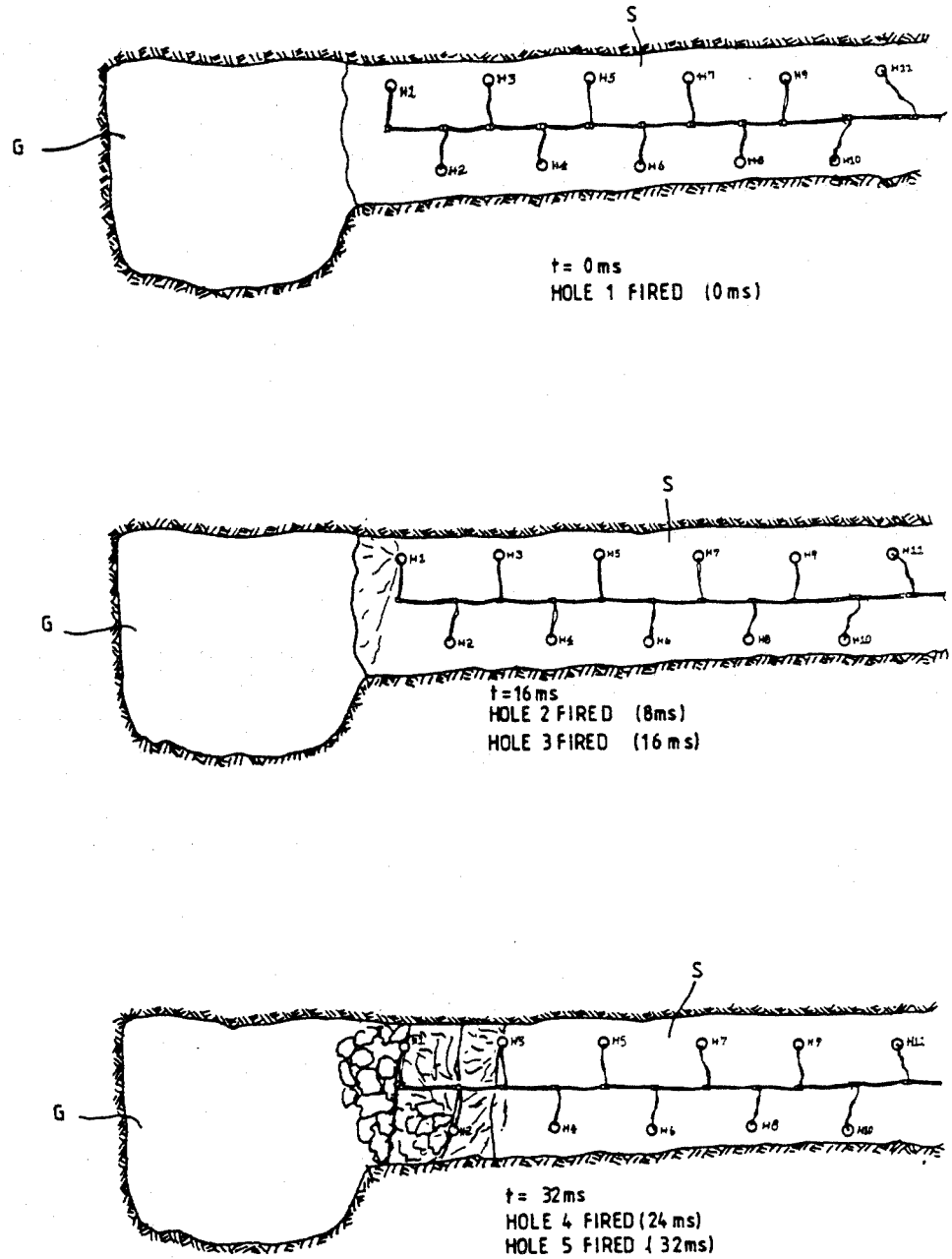
FIG. 2 is a diagrammatic representation illustrating the method of the invention.
Figure 2:
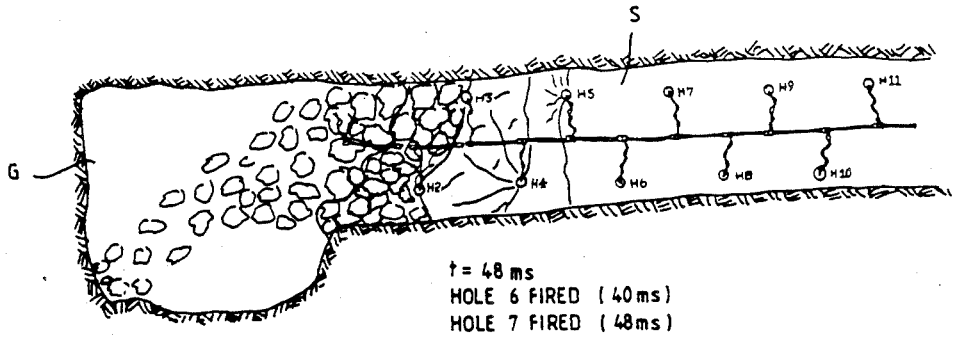
Figure 2:
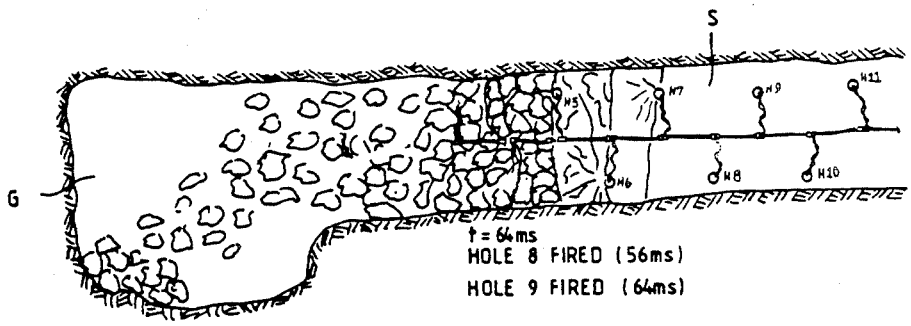
Figure 2:
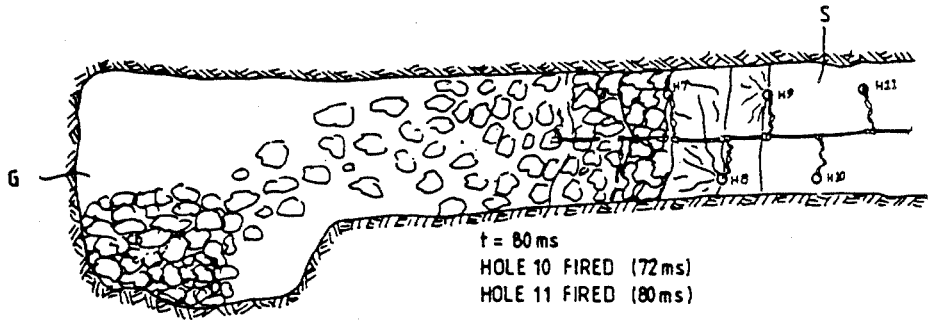

The invention is illustrated for use in concentrated reef mining operations in which a stope S is to be mined. A series of blast holes H1 to H11 is drilled into the stope in staggered formation (FIG. 2). The upper holes are usually drilled at an upward inclination and the lower holes at a downward inclination. The inclination of the holes in the horizontal plane is dependent on the angle that the stope forms with a lateral gulley G. Ideally the rock fragments blasted from the stope should end up in a muck pile in the gulley G from where the rock is removed by scrapers.

Figure 1:
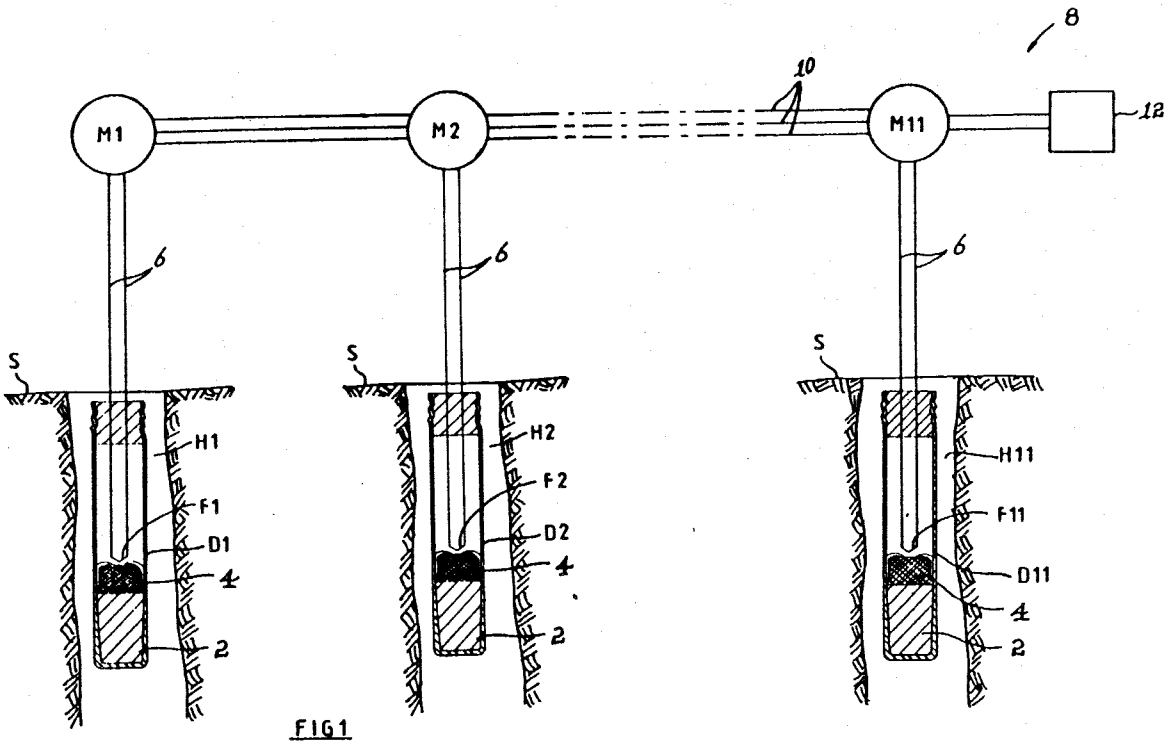
FIG. 1 electrical sequential initiation system used in carrying out the method of the invention.

Each blast hole H1 to H11 is charged with explosive material such as Anfex [not shown] and has a detonator D located therein, designated D1 to D11 (FIG. 1). The detonators D1 to D11 are shown enlarged for the sake of clarity. Each detonator D comprises an aluminium capsule carrying a base charge 2 such as PETN at its inner end. An intiating charge 4, such as a 4:1 mixture of lead azide and lead styphnate, is located adjacent the base charge 2.

Each detonator D1 to D11 carries an initiator F, designated F1 to F11, adapted to fire the detonator. When initiated, an initiator F will ignite the initiating charge 4, which will ingite the base charge 2, which in turn will set off the explosive material in the blast hole H. In one form, each of the initiators F1 to F11 may comprise a fusible metal link which is ignited when an electrical current of a selected magnitude passes through it and which is rendered an open current once it has been fused.

The initiators F1 to F11 are connected by wires 6 to modules M1 to M11 of an electrical sequential initiation system 8. The modules M1 to M11 are connected to one another by trunk wires 10. The initiation system 8 may be of the kind which is more fully described in our co-pending application entitled "Mining Method" of even date, incorporated herein by reference. It is powered by a shot initiator 12 which provides electrical pulses sequentially to initiate the firing of the detonators D1 to D11. The initiation system 8 is characterised in that each module M embodies switching means [not shown] which, except in the case of the first module M1, is connected to the initiator F of the preceding module. The arrangement is such that each module M remains disabled until the initiator F of the preceding module is fired and rendered an open circuit.

Figure 3:
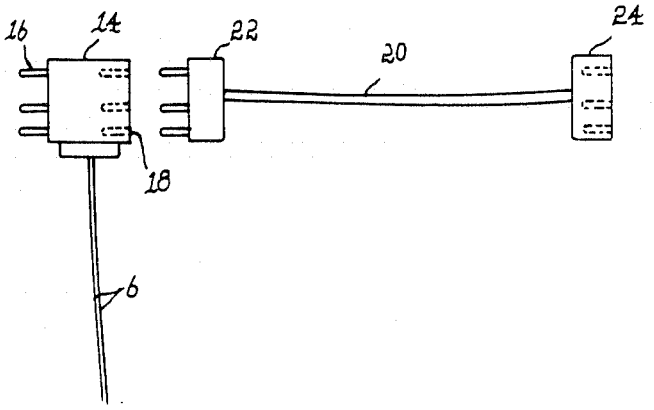
FIG. 3 shows a connector used in the system of FIG. 1.

Each of the modules M1 to M11 is encapsulated in a connector 14 having prongs 16 on one side and corresponding sockets 18 on its opposite side (FIG. 3). Adjacent connectors 14 are connected by lengths of electrical cable 20 carrying the trunk wires 10 and having connecting elements 22, 24 at opposite ends thereof carrying prongs and sockets corresponding to those of the connectors 14.

It is a particular feature of the invention that the detonators D1 to D11 are fired sequentially without the provision of a delay between the initiation of firing of each detonator D at the shot initiator 12 and the actual commencement of firing thereof. It is a further particular feature of the invention that the firing interval is selected from a range of 5 ms to 40 ms.

In FIG. 2, a firing sequence is illustrated diagrammatically in which the firing interval is 8 ms. When t=0, the first pulse from the shot initiator passes from the module M1 through the initiator F1 and it commences to ingite. The remaining modules remain blocked to electrical current from the shot initiator 12. Ignition of initiator F1 is completed and it is rendered an open circuit. When t=8 ms, the second pulse from the shot initiator commences which the module M2 passes through the second initiator F2. It is ignited and is rendered an open circuit. When t=16 ms the third pulse from the shot initiator passes through initiator F3, and so the firing sequence continues.

It will be understood that for the initiation system to function, the time taken for the ignition of each initiator F plus the time taken for it to be rendered an open circuit, must be less than the firing interval.

When the initiator F1 ignites, it ignites the initiation charge 4, which ignites the base charge 2, which in turn sets off the blast in hole H1. The blast does not immediately result in movement of the rock burden located to the left of hole H1. As illustrated in FIG. 2, at t=16 ms, it is expected that no movement of rock will yet have occurred. It is only at t=32 ms that the rock burden of hole H1 will visibly have started to move as a result of the blast. By this time, however, commencement of firing of detonator D5 has already started.

With the movement of the rock burden of each hole H, the connector 14 and cable 20 associated with that hole will be destroyed in the blast. However, this will not affect the firing of subsequent detonators in the series since the firing of each detonator D is dependent only on the initiator F of the immediately preceding detonator having been rendered an open circuit. The manner of interconnection of the connectors 14 by means of the cables 20 also ensures easy separation of a connector 14 when the blast associated with that connector occurs.

The firing interval which is selected for the blasting sequence may be varied according to the blasting characteristics required. In particular, it may be varied according to the rock conditions encountered.

It is considered that the rockbreaking method of the invention could result in greater fragmentation of rock being obtained than by the use of conventional methods. It is also considered that, because of the interaction of rock particles emanating from neighbouring holes, improved rock throw into the gulley G will be obtained with the method of the invention. This is expected to arise because each blast should produce both relatively slow moving and fast moving particles and faster moving particles from, say, hole H5 will impinge on slower moving particles from the preceding hole H4 and accelerate the latter.

Whilst the method of the invention has been described with reference to the electrical sequential initiation system 8 described in our aforementioned co-pending patent application, any other suitable initiation system may be employed.

Many other embodiments of the invention may be made differing in matters of detail only from that described above and without departing from the scope of the invention as defined in the appended claims.

We claim:

1. A method for the electrical sequential initiation of explosions, comprising:

locating a detonator in each of a series of blast holes which are spaced from one another, each of said detonators being connected to one of a plurality of initiation means for firing said detonators, said initiation means being connected to an electrical shot initiator;

loading an explosive charge in each of said blast holes, each explosive charged in each blast hole being in initiating contact with said detonator located in said blast hole; and firing said detonators sequentially at a selected firing interval of 5 ms to 40 ms to detonate said explosive charges, each detonator being fired by an electrical impulse from said shot initiator passed through said initiation means connected to said detonator without the provision of a delay between initiation of firing of said detonator at said shot initiator and actual commencement of firing of said detonator.

2. A method as claimed in claim 1 in which said firing interval is selected from a range of 8 ms to 18 ms.

3. A method as claimed in claim 1 in which each of said detonators is provided with an initiator which is rendered an open circuit when said detonator is fired from said shot initiator.

4. A method as claimed in claim 1 in which each initiation means in said plurality of initiation means is disabled until said detonator associated with the immediately preceding initiation means in said plurality has been fired.

5. Apparatus suitable for use in the method of claim 1 for the electrical sequential firing of a series of detonators, said apparatus comprising a shot initiator, a plurality of initiation means connected to one anther and to said shot initiator for firing said detonators, and a corresponding plurality of electrically actuable initiators each associated with one of said detonators, each initiation means comprising switching means actuable to actuate said initiator associated with said initiation means, each initiation means except the first in said plurality being connected to said initiator associated with the preceding initiation means in said plurality, each initiation means being disabled until said detonator associated with the immediately preceding initiation means in said plurality has been fired, said shot initiator sequentially firing said detonators at a firing interval selected from a range of 5 ms to 40 ms by means of an electrical pulse passed through said initiation means.

6. Apparatus as claimed in claim 5, in which each initiator comprises a fusible metal link which is rendered an open circuit when fused.

7. Apparatus as claimed in claim 5, in which each initiation means is encapsulated in a connector having prongs on one side and corresponding sockets on an opposite side, adjacent connectors being adapted to be connected by lengths of electrical cable having connecting elements at opposite ends thereof carrying prongs and sockets respectively corresponding to those of said connectors.

* * * * *